United States Patent [19]

Feingold

[11] 4,153,855

[45] May 8, 1979

[54] METHOD OF MAKING A PLATE HAVING A PATTERN OF MICROCHANNELS

[75] Inventor: Robert M. Feingold, Annandale, Va.

[73] Assignee: The United States of America as represented by the Secretary of the Army, Washington, D.C.

[21] Appl. No.: 861,139

[22] Filed: Dec. 16, 1977

[51] Int. Cl.[2] ..... B05D 3/06

[52] U.S. Cl. ..... 313/105 CM; 156/633; 156/657; 156/659; 427/43; 427/54; 96/44

[58] Field of Search ..... 427/43, 54; 313/103 CM, 313/105 CM; 156/630, 632, 633, 657, 659, 663; 96/44

[56] References Cited

U.S. PATENT DOCUMENTS

| | | | |
|---|---|---|---|
| 2,806,958 | 9/1957 | Zunick | 156/663 |
| 3,231,380 | 1/1966 | Law | 156/630 |
| 3,275,428 | 9/1966 | Siegmund | 313/105 CM |
| 3,294,504 | 12/1966 | Hicks | 156/663 |
| 3,492,523 | 1/1970 | Smith et al. | 313/105 CM |

*Primary Examiner*—John H. Newsome

*Attorney, Agent, or Firm*—Nathan Edelberg; Milton W. Lee; Aubrey J. Dunn

[57] ABSTRACT

An unetched microchannel plate is coated on one side with an etchant-resistant mask having a pattern of open areas. The core fibers in the open areas are then etched out to form a pattern of microchannels. The microchannels and the mask are metallized, after which the mask and its metal are stripped. When the other side of the plate is metallized in the usual manner, a microchannel intensifier plate with a pattern of microchannels results.

3 Claims, 5 Drawing Figures

METHOD OF MAKING A PLATE HAVING A PATTERN OF MICROCHANNELS

The invention described herein may be manufactured, used, and licensed by the U.S. Government for governmental purposes without the payment of any royalties thereon.

BACKGROUND OF THE INVENTION

This invention is in the field of microchannel plates such as those used as electron multipliers. Such plates usually consist of millions of tiny ~50μM or smaller diameter) tubes cordwood packed, and with a high voltage applied between the tube ends. Typical of electron multipliers using microchannel plates as those shown in U.S. Pat. Nos. 3,497,759 and 3,528,101. Currently, there are two methods whereby such plates are produced: (1) hollow tubes are cordwood stacked, are fused together, are drawn down in size, are cut and again cordwood stacked, and are again drawn, etc. as many times as necessary; (2) clad cores are cordwood stacked, etc. the same as hollow tubes, but the cores are etched out when the cores are drawn down to the proper size. These two methods are known respectively as "hollow drawn" and "etched-core." The plate as made by either method is prepared for use as an electron image multiplier by evaporating metal electrodes on each side of the plate, with the metal extending into the channels. In use, a high voltage is applied to the electrodes. The instant invention is concerned only with etched-core plates, wherein it is desirable to produce a plate with a pattern consisting of cores etched open from end to end and metallized and cores only partially open and not metallized. One method by which an equivalent of the invention has been attempted includes the steps of selectively masking a microchannel plate (either hollow drawn or etched-core) and metallizing through the mask. However, this method requires a high precision vacuum mask and manipulator. Moreover, a true equivalent is not produced if the pattern is made on the input side of the plate because of a possibility of input electrode edge glow. This glow shows up as excessive dark current by active channels at the edges of the input electrode.

BRIEF SUMMARY OF THE INVENTION

The invention is a method of making from a unetched microchannel plate a plate having a pattern of microchannels. The unetched microchannel plate is coated on one side with an etchant-resistant mask. When etchant is applied, those fibers of the plate not covered by the mask are etched open to form channels. The channels and the mask are metallized, the mask and its metal are stripped, and the usual metallizing for the other side of the plate is performed.

BRIEF DESCRIPTION OF THE DRAWINGS

The drawings taken together form a flow chart for the method of the invention and.

DETAILED DESCRIPTION OF THE INVENTION

Figure 1:
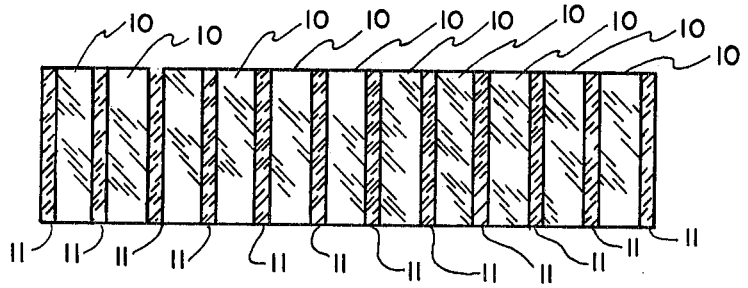
FIG. 1 is a schematic showing of an unetched microchannel plate upon which the invention is practiced.
Figure 2:
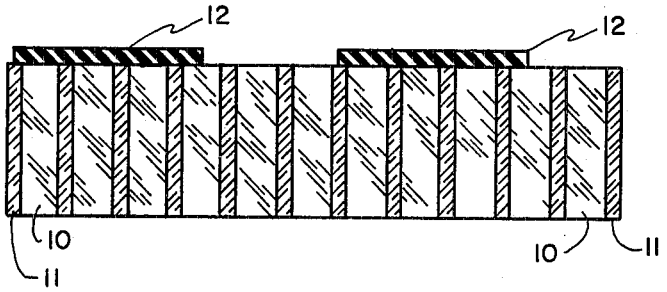
FIG. 2 shows the plate of FIG. 1 with a mask applied.
Figure 3:
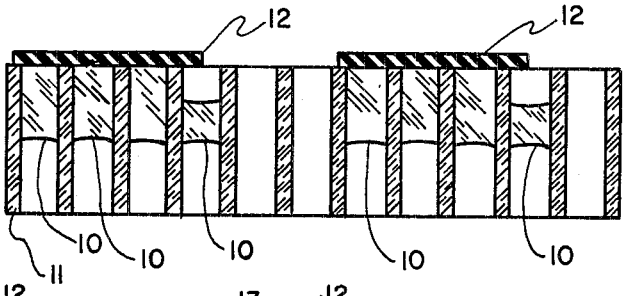
FIG. 3 shows the plate after etching.
Figure 4:
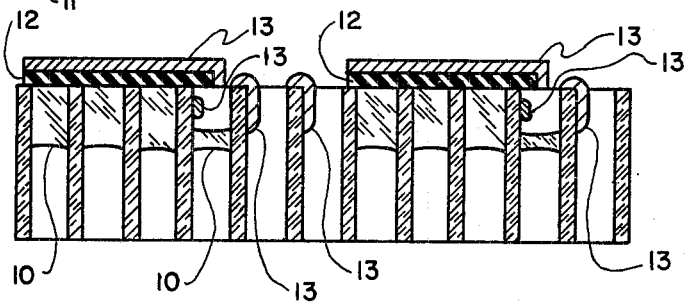
FIG. 4 shows the etched plate after metalization of one side.
Figure 5:
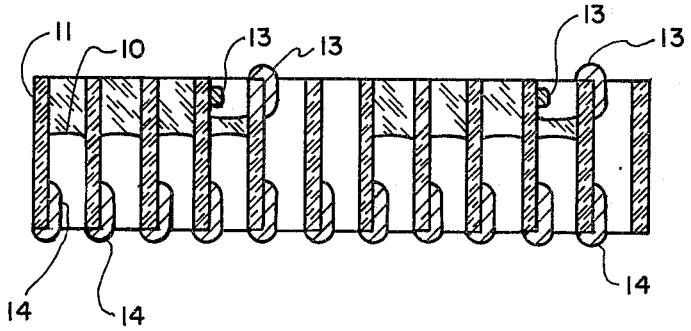
FIG. 5 shows the plate after the mask and its metal is removed and the other side of the plate is metallized.

The invention may perhaps be best understood by referring to the drawings, in which FIG. 1 shows an unetched microchannel plate consisting of cores 10 in cladding 11. In FIG. 2 this plate is shown with etchant-resistant mask 12 thereon. This mask may be applied using standard photo-masking or other techniques. Typically such techniques include the steps of coating with a photosensitive layer, exposing the layer to a light image, and developing the layer to remove unexposed portions thereof. FIG. 3 shows the plate after unmasked cores have been etched out by a selective etchant, such as HCl or HF, in the usual manner. It is clearly seen that some of the cores are completely etched out while others are only partially etched in accordance with the placement of the etchant-resistant mask 12. The etched plate is then metallized at 13 by evaporation or the like to produce the metallized plate or electrode, as shown in FIG. 4. The evaporation or deposition of the metal 13 is performed at approximately a 45° angle above and to the right of the surface to be coated. Note that in FIG. 4 a small metal globule 13 is shown deposited just inside the third and ninth etched cores from the left side of the plate. This globule of metal actually serves no known useful purpose but does in fact exist and thus is shown for the sake of accuracy. Finally, the mask and its metal are stripped by an etchant such as NaOH and the other side of the plate is metallized with metal 14, again at approximately a 45° angle, as FIG. 5 shows. At this point the plate undergoes the usual processing steps as a standard microchannel plate, which steps include: cleaning, activation, evaporation of the remaining electrode at a 45° angle (metal 14 of FIG. 5).

Although only the basic steps necessary for the invention have been described, it should be understood that various steps of washing, passivating, etc. may be used, but that such steps are obvious to one skilled in the art. The manner of fabricating the microchannel plate upon which the instant invention is used is well known in the art and is not part of the instant invention.

I claim:

1. A method of treating an unetched microchannel plate to produce a microchannel plate having a pattern of channels, the method including the steps of:

applying a mask to one side of said unetched microchannel plate in accordance with said pattern:

etching the cores not covered by said mask to produce channels;

metallizing the channels and the mask; and stripping the mask.

2. The method as recited in claim 1 wherein the step of applying includes the steps of:

coating said one side of said unetched microchannel plate with a photoresist;

exposing said photoresist to a light image of said pattern; and developing said photoresist to selectively remove said photoresist in accordance with said image to produce said mask.

3. The product produced by the method of claim 1.

* * * * *